US006045749A

United States Patent [19]

Garg et al.

[11] Patent Number: 6,045,749

[45] Date of Patent: Apr. 4, 2000

[54] METHOD FOR DE-LUBRICATING POWDER METAL COMPACTS

[75] Inventors: Diwakar Garg, Emmaus; Donald James Bowe, Macungie; James Garfield Marsden, Lenhartsville; Kerry Renard Berger, Lehighton; Xianming Li, Orefield, all of Pa.

[73] Assignee: Air Products and Chemicals, Inc., Allentown, Pa.

[21] Appl. No.: 09/324,162

[22] Filed: Jun. 2, 1999

Related U.S. Application Data

[62] Division of application No. 09/131,269, Aug. 7, 1998, Pat. No. 5,970,308.

[51] Int. Cl.[7] ..... B22F 3/12

[52] U.S. Cl. ..... 266/252

[58] Field of Search ..... 266/252

[56] References Cited

U.S. PATENT DOCUMENTS

| | | | |
|---|---|---|---|
| 5,298,090 | 3/1994 | Garg et al. | 148/208 |
| 5,417,774 | 5/1995 | Garg et al. | 148/208 |
| 5,578,147 | 11/1996 | Nayar et al. | 148/508 |
| 5,951,737 | 9/1999 | Lefebvre et al. | 75/252 |

OTHER PUBLICATIONS

"The Drever Rapid Burn–Off (RBO)", Drever Company.
"Getting Rid of Lubricants Vital for PM Part Quality", PM Technology Trends, Feb., 1994.
Phillips et al., Understanding Parameters for Removal of Lubricants from P/M Tool Steels and Stainless Steels.
Hwang et al., "Lubricant Removal in Metal Powder Compacts", The International Journal of Powder Metallurgy, 1992, vol. 28, No. 4, p. 353–360.
Phillips et al., "Optimizing N2/H2 Atmospheres for P/M Lubricant Removal", Apr., 1992, p. 35–38.
Gregory J. Markievich, "Open–Ended Gas–Fired Radiant Tubes Improve Delubing Operation in P/M Sintering" Industrial Heating, Feb., 1993, p. 38–39.
"Abbott High Temperature Ceramic Belt Furnace", Abbott Furnace Co., 1068 Trout Run Road, P.O. Box 967, St. Marys, PA 15857.
"Advanced Delubing Systems", Abbott Furnace Company Product Highlights, 1068 Trout Run Road, P.O. Box 967, St. Marys, PA 15857.
Renowden et al., Liquid Air Corporation, "Experimental Studies on Lubricant Removal", p. 261–278.
"Over Half a Century of Innovation in the Heat Processing Industry", Drever Furnaces Experience the Difference, p. 1–16.
"Ancorsteel 1000–Atomized Steel" Product Bulletin 169D, Hoeganaes Corporation, Riverton, NJ 08077.

*Primary Examiner*—Daniel J. Jenkins
*Attorney, Agent, or Firm*—John M. Fernbacher

[57] ABSTRACT

A method and apparatus for introducing an oxidant mixed with a carrier gas into pre-heating zone of a continuous furnace for effectively removing lubricant from powder metal compacts prior to sintering at high temperatures. Mixing a controlled amount of a gaseous oxidizing agent such as moisture, carbon dioxide, air or mixtures thereof with a carrier gas and introducing the mixture into the preheating zone of a continuous furnace under controlled conditions accelerates removal of lubricant from powder metal compacts prior to sintering at high temperature by decomposing lubricant vapors into smaller and more volatile hydrocarbons, produces sintered components with close to soot- and residue-free surfaces and with the desired physical properties, prolongs the life of furnace components including muffles and belts, and reduces downtime, maintenance and operating costs.

5 Claims, 5 Drawing Sheets

METHOD FOR DE-LUBRICATING POWDER METAL COMPACTS

This is a division of Ser. No. 09/131,269, filed Aug. 7, 1998, now U.S. Pat. No. 5,970,308.

CROSS REFERENCE TO RELATED APPLICATION

Not applicable

STATEMENT REGARDING FEDERALLY SPONSORED RESEARCH OR DEVELOPMENT

Not applicable

BACKGROUND OF THE INVENTION

The present invention relates to the field of powder metallurgy and in particular to the treatment of powder metal compacts.

Powder metallurgy is becoming increasingly important for producing near net shape simple- and complex-geometry components used by the automobile and appliance industries. It involves pressing metal powders to make green compacts and sintering them at high temperatures in the presence of a protective atmosphere. Small amounts of a lubricant, such as metallic stearates (zinc, lithium and calcium), ethylene bisstearamide (EBS), polyethylene waxes, etc., is usually added to metal powders prior to pressing green compacts. The addition of a lubricant reduces interparticle friction and improves powder flow, compressibility and packing density. It also helps in reducing friction between the metal powder and die wall, thereby decreasing force required to eject compacts from the die, thus reducing die wear and prolonging die life.

Although it is important to add a small amount of lubricant to metal powders prior to pressing green compacts, it is equally important to remove it from compacts prior to sintering them at high temperatures in a furnace. A continuous furnace equipped with three distinct zones: a pre-heating zone, a high heating zone, and a cooling zone is commonly used to thermally process and sinter metal powder components. The pre-heating zone of the continuous furnace is used to preheat components to a predetermined temperature. The high heating zone is obviously used to sinter components, and the cooling zone is used to cool components prior to discharging them from a continuous furnace.

It is common practice in the industry to remove the lubricant from green compacts prior to exposing them to sintering temperature in the high heating zone of a batch or continuous furnace. Improper removal of lubricant from powder metal compacts prior to sintering is known to result in poor metal bonding and produces components with low strength. It can also increase porosity, cause blistering and provide poor carbon and dimensional control in the sintered components. Furthermore, improper lubricant removal results in internal and external sooting of components and deposits in the pre-heating and high heating zones of the furnace, which in turn reduce the life of furnace components, such as the belt and muffle.

Lubricant is usually removed by (1) heating powder metal green compacts to a temperature ranging from 400° F. to 1,450° F., (2) melting and vaporizing the lubricant, (3) diffusing lubricant vapors from the interior to the surface of compacts, and (4) sweeping vapors away from the surface or decomposing them into smaller and more volatile components (or hydrocarbons) as soon as they diffuse out to the surface of compacts. Lubricant can be removed from compacts prior to sintering in an external lubricant removal furnace (or de-lubricating furnace) or in the preheating zone of a continuous furnace simply by sweeping vapors away from compacts with a protective atmosphere. It is believed that an effective sweeping of lubricant vapors from the surface of compacts with a protective atmosphere reduces partial pressure of vapors close to the surface of compacts, thereby (a) increasing rate of diffusion of vapors from the interior to the surface of compacts and (b) improving efficiency of removing lubricant. An effective sweeping of vapors from the surface of compacts requires very high flow rate of a protective atmosphere, making the use of high protective atmosphere flow rate economically unattractive. Furthermore, the use of a separate de-lubricating furnace is not desirable because it is expensive and it requires extra floor space which is generally not available in existing plants.

Lubricant can alternatively be removed by decomposing lubricant vapors to smaller and more volatile components as soon as they diffuse out to the surface of compacts. Decomposition of vapors to more volatile components or products as soon as they (vapors) diffuse out to the surface decreases partial pressure of lubricant vapors close to the surface of compacts, thereby accelerating the de-lubricating process. This can, once again, be accomplished in a separate de-lubricating furnace or in the pre-heating zone of a continuous furnace. For example, lubricant has been removed from compacts in a separate de-lubricating furnace by treating lubricant vapors with high temperature combustion by-products such as carbon dioxide and moisture. These separate de-lubricating furnaces are currently marketed by, Drever Company of Huntington Valley Pa., by C. I. Hayes of Cranston R. I. as a rapid burn off system (RBO), by Sinterite Furnace Division of St. Marys, Pa. as an accelerated de-lubricating system (ADS), and by Abbott Furnace Co. of St. Marys Pa. as a quick de-lubricating system (QDS). However, separate de-lubricating furnaces are expensive and require additional floor space that is generally not available in existing plants. Furthermore, they are very expensive to maintain and operate.

Decomposing lubricant vapors to smaller and more volatile components or products as soon as they diffuse out to the surface of compacts can be accomplished by using a high concentration of hydrogen in the protective atmosphere or by adding an oxidant such as air, moisture or carbon dioxide in the pre-heating zone of a continuous furnace. Numerous attempts have been made by researchers to use a high concentration of hydrogen in the protective atmosphere to decompose lubricant vapors and accelerate de-lubricating process, but with limited success. Likewise, several attempts have been made by researchers to accelerate de-lubricating in the pre-heating zone of a continuous furnace by using an oxidizing agent such as moisture, carbon dioxide or air, once again with limited success. Therefore, there is a need to develop an effective and economical method for de-lubricating powder metal compacts in the pre-heating zone (or prior to sintering them in the high heating zone) of a continuous furnace.

BRIEF SUMMARY OF THE INVENTION

The present invention pertains to a new method and apparatus for introducing an oxidant mixed with a carrier gas into the pre-heating zone of a continuous furnace for effectively removing lubricant from powder metal compacts prior to sintering them at high temperatures. Specifically, the method of the invention involves mixing a controlled amount of a gaseous oxidizing agent such as moisture, carbon dioxide, air or mixtures thereof with a carrier gas and introducing the mixture into the pre-heating zone of a continuous furnace as a series of jets through a device or devices to provide good interaction between the oxidant and lubricant vapors. Good interaction between lubricant vapors and an oxidant is unexpectedly found to (1) accelerate removal of lubricant from powder metal compacts prior to sintering them at high temperatures by decomposing lubricant vapors into smaller and more volatile hydrocarbons, (2) produce sintered components with close to soot- and residue-free surfaces and with desired physical properties, (3) prolong life of furnace components including muffle and belt, and (4) reduce downtime, maintenance, and operating costs. The amount of an oxidizing agent mixed with a carrier gas is controlled in such a way that it is high enough to be effective in removing most of the lubricant from the compacts, but not high enough to oxidize compacts. Furthermore, the flow rate of an oxidizing agent and carrier gas mixture introduced as a series of jets through the device according to the invention is selected in such a way that the momentum of these jets is high enough to penetrate streamlines of the main protective atmosphere flow in the pre-heating zone of the furnace and provide good interaction between the oxidizing agent and lubricant vapors.

Therefore, in one aspect the present invention is a method for removing lubricants from powder metal compacts containing a lubricant used to form said powder metal compacts, comprising the steps of; pre-heating said powder metal compacts to a temperature of at least about 400° F. but no greater than about 1500° F. under a protective atmosphere, and contacting said compacts with a de-lubricating atmosphere consisting of a carrier gas mixed with an oxidizer selected from the group consisting of air, water vapor, carbon dioxide and mixtures thereof during said pre-heating when said compacts have reached a temperature of between 400° F. and 1500° F., said contact being effected in a manner that will provide interaction between the oxidant and lubricant vapors at surfaces of said compacts exposed to said furnace and de-lubricating atmosphere.

In another aspect the present invention is a method of removing lubricants from powder metal compacts treated by heating in a continuous sintering furnace having a pre-heating zone and a high temperature sintering zone through which said compacts move in sequence and wherein said pre-heating and sintering zones are maintained under a protective atmosphere, the improvement comprising; introducing a de-lubricating atmosphere consisting of a carrier gas with an oxidizer selected from the group consisting of air, water vapor, carbon dioxide, and mixtures thereof into said pre-heating zone at a point in said zone when said powder metal compacts are at a temperature of between about 400° F. and 1500° F., said de-lubricating atmosphere introduced as a flow of atmosphere transverse to movement of said powder compacts through said furnace, at a flow rate sufficient to provide interaction between said oxidixer and lubricant vapor, said oxidizer being present in an amount to accelerate lubricant removal from said powder compacts without oxidizing said powder compacts and without causing excessive soot to be generated in said furnace.

The present invention also relates to a device for introducing a de-lubricating atmosphere into a furnace comprising in combination; a conduit having a first end and a second end, said conduit adapted to extend across the width of said furnace in one of said furnace or a portion of said furnace where articles to be de-lubricated are heated to a temperature of between about 400° F. and 1500° F., said conduit containing a plurality of apertures to direct an atmosphere introduced into a first end of said conduit at said articles said apertures adapted to introduce said atmosphere in a turbulent flow regime said conduit constructed to have a diffuser design criteria of about 1.5 or higher, said diffuser design criteria (DDC) determined according to the equation:

$$DDC = \frac{D}{d\sqrt{N}} \text{ wherein:}$$

D is the diameter of, or equivalent diameter if it is not circular in cross-section, of said conduit, d is the diameter of the apertures and N is the total number of apertures.

DETAILED DESCRIPTION OF THE INVENTION

Figure 1:
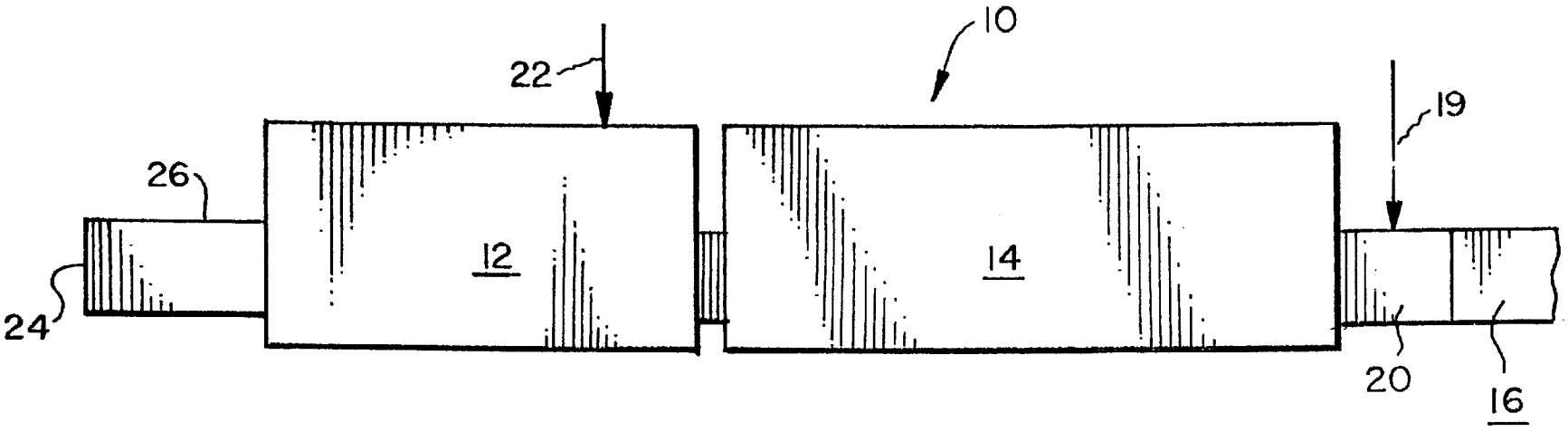
FIG. 1 is a schemetic representation of a continuous furnace for sintering powder metal parts.

Powder metallurgy is important for producing near net shape simple- and complex-geometry carbon steel components used by the automobile and appliance industries. Powder metal part fabrication involves pressing metal powders to make green compacts followed sintering the green compacts at high temperatures in a batch or continuous furnace in the presence of a protective atmosphere.

Continuous furnaces used for sintering metal compacts or components generally consist of a preheating zone to preheat powder metal green compacts, a high heating zone to sinter compacts at high temperatures and a cooling zone. The protective atmosphere used for sintering is produced and supplied by endothermic generators, nitrogen mixed with endothermically generated atmosphere, dissociated ammonia, nitrogen mixed with an atmosphere produced by dissociating ammonia, or by simply blending pure nitrogen with hydrogen, blending nitrogen with hydrogen and an enriching gas such as natural gas or propane, or blending nitrogen with methanol. The protective atmosphere is introduced into the continuous furnace in a transition zone located between high heating and cooling zones of the furnace. Endothermic atmospheres containing nitrogen (~40%), hydrogen (~40%), carbon monoxide (~20%), and low levels of impurities, such as carbon dioxide, oxygen, methane, and moisture are produced by catalytically combusting controlled amount of a hydrocarbon gas, such as natural gas in air in endothermic generators. Atmospheres produced by dissociating ammonia contain hydrogen (~75%), nitrogen (~25%), and impurities in the form of undissociated ammonia, oxygen, and moisture.

Small amounts of a lubricant, such as metallic stearates (zinc, lithium and calcium), ethylene bisstearamide (EBS), polyethylene waxes, etc., is usually added to metal powders prior to pressing green compacts. The addition of a lubricant reduces interparticle friction and improves powder flow, compressibility and packing density. It also helps in reducing friction between the metal powder and die wall, thereby decreasing force required to eject compacts from the die, reducing die wear and prolonging die life.

Although it is important to add a small amount of a lubricant to metal powders prior to pressing green compacts, it is equally important to remove it from compacts prior to sintering them at high temperatures in the high heating zone of a continuous furnace. Improper removal of the lubricant from compacts prior to sintering is well known to result in poor metal bonding, increase porosity, cause blistering, provide poor carbon and dimensional control in sintered components, internal and external sooting of the components and deposits in the preheating and high heating zones of the furnace, the deposits in turn reducing the life of furnace components such as the belt and muffle. Lubricant is usually removed by the techniques that were available prior to the present invention.

The removal of lubricant from green compacts in the pre-heating zone of a continuous furnace is believed to depend on a number of factors including heating rate of green compacts, operating temperature of the pre-heating zone, flow rate of the main protective atmosphere employed, height of the furnace, etc. It is believed that lubricant starts to vaporize and lubricant vapors start to diffuse out of green compacts as the compacts are heated in the pre-heating zone of a continuous furnace. The diffusion rate of lubricant vapors from green compacts increases with an increase in temperature up to a certain temperature, beyond which lubricant vapors start to pyrolyze or carbonize within the main body of compacts, thereby incorporating undesirable by-products or residue such as (a) metal, metal oxide and carbon when metallic stearate is used as a lubricant, or (b) carbon when ethylene bisstearamide or polyethylene wax is used as a lubricant into the main body of compacts. The formation of soot and residue within the main body of compacts is not desirable because they can reduce or adversely effect the mechanical properties of the sintered components. It is, therefore, desirable to diffuse a majority of lubricant vapors out of compacts prior to reaching that temperature at which lubricant vapors start to pyrolyze within the main body of compacts. It is also desirable to carefully control the maximum operating temperature of the pre-heating zone and heating rate of compacts to avoid pyrolyzing of lubricant vapors within the main body of compacts.

The diffusion of lubricant vapors from green compacts is believed to depend on how fast lubricant vapors are removed from the surface of compacts. If lubricant vapors are not removed quickly from the surface of compacts, they form a barrier on the surface. They reduce overall diffusion rate of lubricant vapors from compacts and result in improper removal of lubricant from compacts. In addition, lubricant vapors start to pyrolyze or carbonize on the surface of compacts, producing undesirable by-products such as soot and residue on the surface. The formation of soot and residue on the surface are not desirable because they require post cleaning steps, thereby increasing overall processing cost. It is believed that diffusion rate of lubricant vapors from green compacts can be accelerated by removing lubricant vapors from the surface as soon as they diffuse out to the surface. This can be accomplished, as stated earlier, by using a very high flow rate of a protective atmosphere. However, high protective atmosphere flow rate is seldom used because this technique is economically unattractive.

It is believed that the flow rate of a protective atmosphere commonly used by the powder metal industry does not allow lubricant vapors to be removed rapidly enough from the surface of the compacts as the vapors diffuse out to the surface of compacts. Consequently, lubricant vapors form a diffusion barrier on the surface and hinder in effective removal of lubricant from the compacts. Furthermore, lubricant vapors start to pyrolyze or carbonize on the surface of the compacts, forming soot and residue on the surface of the compacts. Therefore, the only way to effectively remove lubricant from compacts is to accelerate removal of lubricant vapors from the surface as soon as they diffuse out to the surface of compacts by a process according to the invention, as will be hereinafter be more fully disclosed and explained.

The rate of lubricant vapors removal from the surface of compacts under normal operating conditions can be increased by using a high concentration of hydrogen in the protective atmosphere. The use of a high hydrogen concentration in the protective atmosphere is believed to increase overall diffusivity of lubricant vapors in the atmosphere. It is also believed that hydrogen facilitates gasification of a part of undesirable soot, if it forms on the surface of the compact. However, an extremely high concentration of hydrogen, (25% or more) is required to make a meaningful change in the diffusivity of lubricant vapors in the protective atmosphere. Furthermore, because of low temperatures (less than 1,500° F.) in the pre-heating zone of the furnace, an extremely high concentration of hydrogen (50% or more), is required to make a meaningful change in gasification of soot formed on the surface of compacts. Since hydrogen is expensive, it is not economically attractive to use such high concentrations of hydrogen in the protective atmosphere.

Another method to increase the rate of lubricant vapors removal from the surface of compacts is by decomposing lubricant vapors to smaller and more volatile components (or hydrocarbons) as soon as they diffuse out to the surface of compacts. This can in theory be done by reacting and decomposing lubricant vapors with an oxidizing agent such as moisture, carbon dioxide, air or mixtures thereof. These oxidizing agents also facilitate in gasifying undesirable soot (if formed) from the surface of compacts. These are the prime reasons that a number of researchers have tried to use them for de-lubricating powder metal green compacts in the pre-heating zone of a continuous furnace, but with limited success. Therefore, there is a need to develop an effective and economical method for de-lubricating powder metal compacts in the pre-heating zone (or prior to sintering them in the high heating zone) of a continuous furnace.

It is conventional to enhance lubricant removal by adding an oxidizing agent to the main protective atmosphere flow. Unfortunately, however, these oxidizing agents are oxidizing to steel components both in the high heating and cooling zones of a continuous furnace. Consequently, it is not desirable to add them to the main protective atmosphere flow. They can alternatively be introduced directly into the pre-heating zone of a continuous furnace to avoid oxidation of sintered components in the high heating and cooling zones of a sintering furnace. For example, they can be introduced directly into the pre-heating zone of a continuous furnace mixed with a carrier gas such as nitrogen or a protective atmosphere. In fact, numerous attempts have been made by researchers to introduce an oxidizing agent along with a carrier gas into the pre-heating zone of a continuous furnace for de-lubricating green compacts, but with limited success.

It has been found that the conventional way of introducing of an oxidizing agent mixed with a carrier gas into the pre-heating zone of a continuous furnace using an open tube or pipe directed into the pre-heating zone of the furnace is not effective in de-lubricating green compacts because of inefficient interaction between the oxidant and lubricant vapors. It has been found that the main protective atmosphere flow in the high heating and pre-heating zones of the furnace follows a streamline flow pattern. Consequently, an oxidizing agent introduced into the pre-heating zone of a continuous furnace using a conventional technique is swept away by streamlines of the main protective atmosphere flow. This means that an oxidizing agent introduced into the pre-heating zone of the furnace has very little opportunity to interact with lubricant vapors to decompose them into smaller and more volatile components (or hydrocarbons), thus allowing lubricant vapors to pyrolyze or carbonize on the surface of compacts, form soot or residue on the surface, and hinder in effective removal of lubricant form compacts.

It has also been unexpectedly found that the removal of lubricant from green compacts can be greatly accelerated by mixing a carefully controlled amount of an oxidizing agent to a carrier gas and introducing the mixture into pre-heating zone of the furnace in such a way that there is good interaction between the oxidant and lubricant vapors. A special device was designed to effect introduction of this oxidizing agent into the furnace. Specifically, the mixture of an oxidizing agent and a carrier gas is introduced into the preheating zone of the furnace as a series of jets through the device to provide good interaction between the oxidant and lubricant vapors. Good interaction between the oxidant and lubricant vapors is unexpectedly found to (1) accelerate removal of lubricant from powder metal compacts prior to sintering them at high temperatures by decomposing lubricant vapors into smaller and more volatile hydrocarbons, (2) produce sintered components with close to soot- and residue-free surface and with desired physical properties, (3) prolong life of furnace components including muffle and belt, and (4) reduce downtime, maintenance, and operating costs. The amount of an oxidizing agent mixed with a carrier gas is controlled in such a way that it is high enough to be effective in removing most of the lubricant from the compacts, but not high enough to oxidize surface of compacts. Furthermore, the flow rate of the mixture of an oxidizing agent and carrier gas introduced into the preheating zone as a series of jets through a device is selected in such a way that the momentum of these jets is high enough to penetrate streamlines of the main protective atmosphere flow in the furnace and provide good interaction between the oxidizing agent and lubricant vapors.

According to the present invention, a continuous furnace 10, such as shown in FIG. 1, equipped with a pre-heating zone 12, a high heating zone 14, and a cooling zone 16 is most suitable for de-lubricating and sintering powder metal compacts. The continuous furnace 10 is preferably equipped with a feed vestibule 26 at an entry end 24. The discharge vestibule (not shown) downstream of the cooling zone 16 is preferably fitted with curtains to prevent air infiltration. The main protective atmosphere, according to the present invention, is introduced into the furnace through an inlet port or multiple inlet ports (shown by arrow) 19 placed in the transition zone 20, which is located between high heating zone 14 and cooling zone 16 of the furnace 10. It can alternatively be introduced through a port located in the heating zone or the cooling zone, or through multiple ports located in the heating and cooling zones.

The protective atmosphere for sintering, according to the present invention, can be produced and supplied by endothermic generators, nitrogen mixed with endothermically generated atmosphere, dissociated ammonia, nitrogen mixed with atmosphere produced by dissociating ammonia, or by simply blending pure nitrogen with hydrogen, blending nitrogen with hydrogen and an enriching gas such as natural gas or propane, or blending nitrogen with methanol.

A mixture of an oxidizing agent and a carrier gas, according to the present invention, is introduced into the pre-heating zone 12 of the furnace which pre-heating zone is capable of operating at a maximum temperature of about 1,600° F., more preferably about 1,500° F. The mixture is introduced into the pre-heating zone 12 at a location or locations shown by arrow 22 where the temperature of the parts being treated (compacts) is maintained between about 400° F. and 1500° F., preferably from 600° F. to 1,450° F., more preferably from 1000° F. to 1450° F. The mixture is introduced into the pre-heating zone through a diffuser (or device) or multiple diffusers (or devices) described below. The carrier gas can be selected from nitrogen or a protective atmosphere. The protective atmosphere can be selected from endothermically generated atmosphere, nitrogen mixed with endothermically generated atmosphere, atmosphere generated by dissociating ammonia, nitrogen mixed with atmosphere generated by dissociating ammonia or by simply blending pure nitrogen with hydrogen, blending nitrogen with hydrogen and an enriching gas such as natural gas or propane, or blending nitrogen with methanol.

Figure 2:
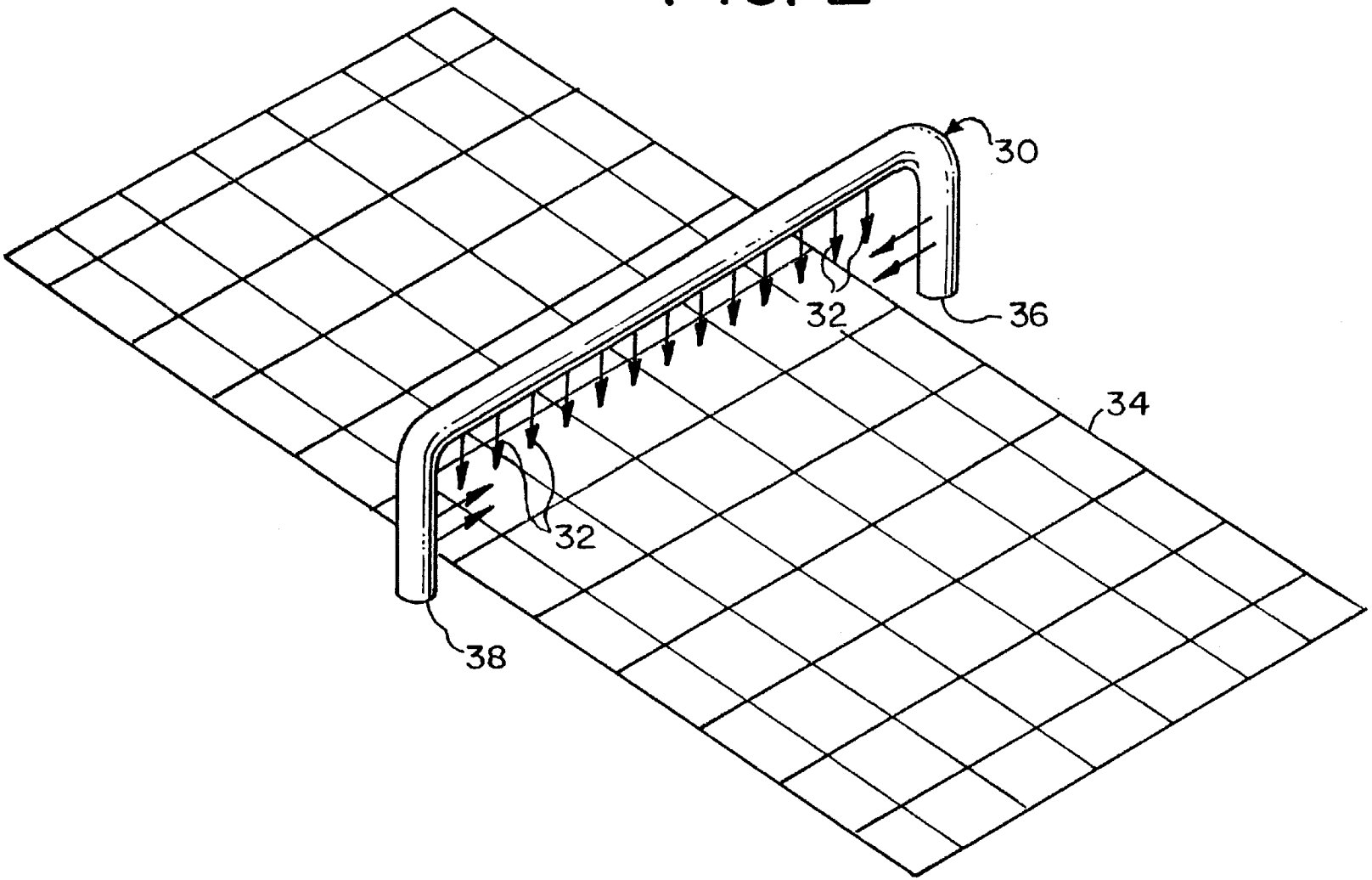
FIG. 2 is a schematic representation of an apparatus according to the invention for practicing the method of the invention.

The diffuser (or device) such as shown as 30 in FIG. 2 is designed to have a number of holes that are preferably equally spaced and equal in diameter indicated by arrows 32. It is designed to cover the entire width of the furnace or at least the entire width of the conveyor belt used in the furnace 10. The diffuser or device 30 can be made out of a steel pipe having a round, square, rectangular, triangular, or oval cross-section. The diffuser is designed to provide equal distribution of the flow of the oxidizing agent and carrier gas mixture through each hole and across the width of the furnace belt. The oxidizing agent and carrier gas mixture is dispensed as a series of jets through these holes. The diffuser or device 30 can be inserted into pre-heating zone 12 of furnace 10 through the side walls. It is placed close to the furnace ceiling. The holes 32 in the diffuser or device 30 can be pointed straight down toward the stainless steel mesh furnace belt 34. Preferably, they can be pointed down with a small offset angle, e.g. between 10° and 15° from a vertical axis (perpendicular to the axis of the pipe). The offset angle is preferably orinted so that the holes or orifices face toward the entry end 24 of furnace 10. The oxidizing agent and carrier gas mixture can be introduced into one end 36 of diffuser 30 with the other end 38 of the diffuser capped or plugged. The diffuser is preferably fabricated from stainless steel.

It is important to carefully design the diffuser (or device) 30 and provide close to equal distribution of flow through each hole 32. It is important that the value of diffuser design criterion (DDC) used in designing a diffuser (or device) is more than 1.4, more preferably more than 1.5 to obtain close to equal distribution of flow through holes. The value of DDC can be calculated by using the following equation:

$$DDC = \frac{D}{d\sqrt{N}}$$

where,

D is the diameter of the pipe or equivalent diameter of the supply tube, if it is not round in cross-section, d is the diameter of a hole, and N is the total number of holes.

It is desirable to select the distance between holes in such a way that the de-lubricating atmosphere introduced as a series of jets form a de-lubricating atmosphere curtain covering the entire width of the furnace or the entire width of the conveyor belt. It would be preferable to select the distance between holes to provide some overlap of jets close to the compacts (components) being treated in the furnace.

The flow rate of the oxidant and carrier gas mixture or de-lubricating atmosphere through a hole depends upon the momentum of jet required not only to penetrate streamlines of the main protective atmosphere flow but also to provide effective interaction between the oxidizing agent and lubricant vapors. The de-lubricating atmosphere introduced into the preheating zone of the furnace as a jet through a hole in the diffuser should be in the turbulent flow regime. More specifically, the Reynolds number of the de-lubricating atmosphere introduced as jet through a hole should be above about 2,000, preferably above about 3,000, and more preferably above about 3,500. Reynolds number is defined as follows:

$$\text{Reynolds number} = \frac{dU\rho}{\mu}$$

where, d is the diameter of a hole,

U is the linear velocity of the de-lubricating atmosphere flow through a hole,

ρ is the density of the de-lubricating atmosphere, and $\mu$ is the viscosity of de-lubricating atmosphere.

The flow rate of the de-lubricating atmosphere through a hole also depends upon the strength of streamlines of the main protective atmosphere flow. The flow rate through a hole required to penetrate streamlines of main protective atmosphere flow and provide good interaction with the lubricant vapors has to be increased with an increase in the main protective atmosphere flow rate. It can be calculated by knowing the strength of the main protective atmosphere flow through the preheating zone of the furnace. For example, it can be calculated from the momentum ratio R which is defined as the ratio of the de-lubricating atmosphere jet momentum to the momentum of the main protective atmosphere flow. In order to penetrate streamlines of main protective atmosphere flow and provide good interaction with the lubricant vapors, the value of momentum ratio should be above about 50, preferably above about 100, and more preferably above about 125. The momentum ratio R is defined by the following equation:

Momentum ratio $$R = \frac{U}{V}\sqrt{\frac{\rho}{\rho a}}$$

where,

ρ is the density of the de-lubricating atmosphere,

ρα is the density of the main protective atmosphere,

U is the linear velocity of the de-lubricating atmosphere flow through a hole, and V is the linear velocity of the main protective atmosphere flow.

It is important to note that the de-lubricating atmosphere flow rate through a hole required to penetrate streamlines of the main protective atmosphere flow and provide good interaction with the lubricant vapors has to be increased with increases in the height of the furnace. The total flow rate of de-lubricating atmosphere required can be calculated by multiplying the flow rate through a hole by the total number of holes in the diffuser. It is important to note that the flow rate through a hole in the diffuser must meet both the Reynolds number and momentum ratio requirements.

The amount of an oxidizing agent added to the carrier gas depends on the total flow rate of the oxidant and carrier gas mixture employed. The amount is selected in such a way that it is high enough to accelerate lubricant removal, but not high enough to oxidize the surfaces of the compact. The right amount of an oxidant can be determined and selected by conducting a few de-lubricating trials. The oxidizing agent used to accelerate removal of lubricant can be selected from moisture, carbon dioxide, air or mixtures thereof.

If moisture is used as an oxidizing agent, it can be added by humidifying the carrier gas. It can also be added by reacting carrier gas containing a predetermined amount of oxygen with hydrogen in the presence of a precious metal catalyst. The amount of moisture added to the carrier gas depends on the total flow rate of the moisture and carrier gas stream mixture used. Specifically, a small amount of moisture is needed with high total flow rate and a large amount of moisture is needed with low total flow rate. The amount or concentration of moisture in the total (moisture plus carrier gas) stream is greater than 0.25%, preferably greater than 0.4%, more preferably greater than 0.6%, even more preferably greater than 1.0%.

The amount of carbon dioxide added to the carrier gas depends on the total flow rate of the carbon dioxide and carrier gas stream mixture used. Specifically, a small amount of carbon dioxide is needed with high total flow rate and a large amount of carbon dioxide is needed with low total flow rate. The amount or concentration of carbon dioxide in the total (carbon dioxide plus carrier gas) stream is greater than 2%, preferably greater than 5%, more preferably greater than 10%, even more preferably greater than 15%.

The amount of air added to the carrier gas depends on the total flow rate of the air and carrier gas stream mixture used. Specifically, a small amount of air is needed with high total flow rate and a large amount of air is needed with low total flow rate. The amount or concentration of air in the total (air plus carrier gas) stream is greater than 0.5%, preferably greater than 1%, more preferably greater than 2%, even more preferably greater than 3%.

Metal powders that can be treated or de-lubricated according to the present invention can be Fe, Fe—C with up to 1% carbon, Fe—Cu—C with up to 20% copper and 1% carbon, Fe-Ni with up to 50% nickel, Fe—Mo—Mn—Cu—Ni—C with up to 1% Mo, Mn, and carbon each and up to 2% Ni and Cu each, Fe—Cr—Mo—Co—Mn—V—W—C with varying concentrations of alloying elements depending upon the final properties of the sintered product desired. Other elements such as B, Al, Si, P, S, etc. can optionally be added to metal powders to obtain the desired properties in the final sintered product. These powders can be mixed with up to 2% lubricant to help in pressing components from them.

The present invention, therefore, is a method and apparatus for introducing an oxidant mixed with a carrier gas into the pre-heating zone of a continuous furnace for effectively removing lubricant from powder metal compacts prior to sintering them at high temperatures. According to the present invention, lubricant is effectively removed from powder metal compacts prior to sintering them at high temperature by mixing a controlled amount of an oxidizing agent to a carrier gas and introducing the mixture into the pre-heating zone of a continuous furnace as a series of jets through a device to provide good interaction between the oxidant and lubricant vapors. A good interaction between the oxidant and lubricant vapors is responsible for (1) accelerating removal of lubricant from powder metal compacts prior to sintering them at high temperatures by decomposing lubricant vapors into smaller and more volatile hydrocarbons, (2) producing sintered components with close to soot- and residue-free surface and with desired physical properties, (3) prolonging life of furnace components including muffle and belt, and (4) reducing downtime, maintenance, and operating costs. The amount of an oxidizing agent added to a carrier gas is controlled in such a way that it is high enough to be effective in removing most of the lubricant from the compacts, but not high enough to oxidize surface of compacts. Furthermore, the flow rate of the mixture of an oxidizing agent and carrier gas introduced as a series of jets through a device is selected in such a way that the momentum of these jets is high enough to penetrate streamlines of the main protective atmosphere flow and provide good interaction between the oxidant and lubricant vapors.

A number of experiments were carried out in a three-zone, 20" wide continuous mesh belt production furnace to de-lubricate and sinter powder metal transverse rupture strength (TRS) test bars and demonstrate the present invention. The furnace 10 used in all the Examples is shown schematically in FIG. 1. It consisted of a 96 inch long pre-heating zone 12 that was operated at a maximum temperature of about 1,450° F. It was used to heat the test bars and remove the lubricant from them prior to sintering them at high temperatures. The pre-heating zone 12 was followed by a 144 inch long high heating zone 14 operated at 2,050° F. to sinter test bars. A 360 inch long water cooled cooling zone 16 partially shown in FIG. 1 immediately followed the high heating zone to cool the sintered test bars. The furnace had a 18" wide stainless steel mesh belt to transport test bars in and out of the furnace. A constant belt speed close to 4 in./min. was used to process test bars in the furnace 10.

The test bars were pre-heated and de-lubricated in the pre-heating zone 12 and sintered in the high heating zone 14 of furnace 10 using a fixed belt speed and temperatures in the pre-heating 12 and high heating 14 zones of furnace 10. Likewise, a fixed time and temperature cycle was used in the high heating zone of the furnace to sinter test bars. The test bars were 0.25 inch high, 0.50 inch wide and 1.25 inch long. They were pressed to 6.8 g/cm$^3$ green density from Hoeganaes A1000 atomized iron powder. The powder was premixed with 0.75 wt. % zinc stearate as a lubricant and 0.9 wt. % graphite to provide a carbon level between 0.7 and 0.8 wt. % in the sintered bars. The belt was fully loaded with parts while conducting de-lubricating and sintering experiments.

Figure 3:
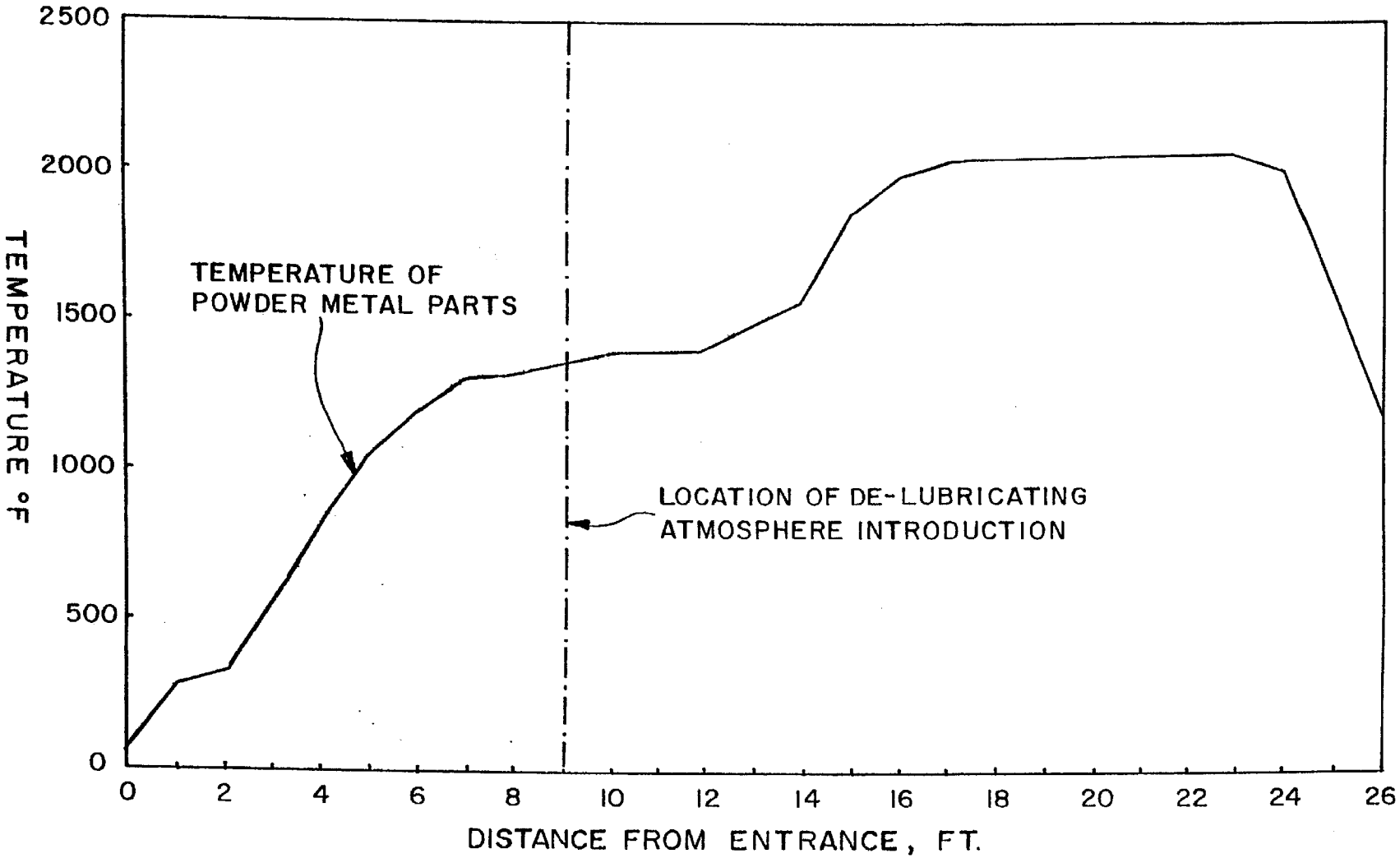
FIG. 3 is a plot of temperature of the compacts against distance from the entry end of the furnace for location of the device of FIG. 2.

A protective atmosphere containing a blend of nitrogen, 3% hydrogen and 0.4% natural gas (main protective atmosphere stream) was introduced, as shown by arrow 19 into the furnace 10 through the transition zone 20 shown in FIG. 1. The same main protective atmosphere composition was used in all the Examples. The total flow rate of the protective atmosphere used for sintering was 1,256 SCFH or 1,456 SCFH. A de-lubricating atmosphere consisting of a nitrogen stream alone or mixed with moisture, carbon dioxide or air was introduced into the pre-heating zone 12 of the furnace 10 to assist in removing lubricant from powder metal test bars. The de-lubricating atmosphere was introduced into the pre-heating zone 12 of furnace 10 using either an improperly designed diffuser or a properly designed diffuser. This atmosphere was introduced into the preheating zone 12 of furnace 10 at a distance of about 9 feet from the beginning of feed vestibule 26, as shown in FIG. 1. The de-lubricating atmosphere was introduced at a point, as shown by arrow 22, in the pre-heating zone 12 where the temperature of test bars has reached 1,400° F., as revealed by the temperature profile in the furnance shown by the plot of FIG. 3. The total flow rate of the de-lubricating atmosphere was varied between 80 SCFH and 350 SCFH.

The moisture in the de-lubricating atmosphere was introduced by passing nitrogen through a humidifier (bubbler), or by blending nitrogen with controlled amounts of hydrogen and air and producing moisture by reacting the oxygen present in the air and hydrogen in the presence of a precious metal catalyst. The moisture level in the de-lubricating atmosphere was varied from 0.4 to 4.5 volume %. Carbon dioxide or air in the de-lubricating atmosphere was introduced simply by blending nitrogen with carbon dioxide or air. The concentration of carbon dioxide in de-lubricating atmosphere was varied from 5 to 80 volume %. Likewise, the concentration of air in the de-lubricating atmosphere was varied from 1.25 to 26.6 volume %.

The improperly designed diffuser was fabricated from a 1 inch diameter pipe. It contained sixteen ¼ inch diameter holes that were equally spaced. These sixteen holes covered the entire width of the stainless steel belt. This improperly designed diffuser was already in the furnace, and was used on a daily basis. A quick design review of this diffuser revealed that it was not designed to provide uniform de-lubricating atmosphere flow through all sixteen holes. The value of DDC for this diffuser was calculated to be 1.0, which is significantly less than the minimum value of 1.4 recommended as an acceptable diffuser design criterion.

A properly designed diffuser 30, as shown in FIG. 2 was fabricated from a ½ inch stainless steel tube. Diffuser 30 contained twenty-two 1/16 inch diameter holes 32 that were equally spaced. The twenty-two holes 32 covered the entire width of the stainless steel belt 34. Holes 32 in the diffuser or device 30 were pointed down with a 15° off-set angle to a vertical line perpendicular to the belt 34 and with the holes pointed or oriented toward the front or entry end 24 of furnace 10. The value of DDC for this diffuser was calculated to be ~1.7, which met the diffuser design criteria.

The de-lubricated and sintered test bars were evaluated for surface appearance, weight and dimensional changes, and apparent hardness of top and bottom surfaces. A few select test bars were evaluated metallographically and tested for transverse rupture strength. The effectiveness of an oxidant for removing lubricant was judged by a combination of surface appearance, apparent surface hardness and strength of the de-lubricated and sintered bars.

EXAMPLE 1

A de-lubricating followed by sintering experiment was carried out in the continuous furnace described above. This experiment was carried out by introducing 1,456 SCFH of the main protective atmosphere containing nitrogen, 3% hydrogen and 0.4% natural gas into the furnace through the transition zone, as described earlier. No other gas including de-lubricating atmosphere was used in this experiment. The furnace was operated using the same parameters including operating temperature, belt speed, etc. as described earlier. A number of transverse rupture strength test bars described earlier were processed along with a full load of parts in the furnace.

The test bars sintered in this experiment were heavily covered with undesirable soot and dark residue, indicating improper removal of lubricant from the test bars in the preheating zone of the furnace. The results of this experiment confirmed that a de-lubricating atmosphere is needed to remove lubricant or sweep away lubricant vapors in the preheating zone of the furnace and avoid the formation of soot and residue.

EXAMPLE 2A

A de-lubricating followed by sintering experiment described in Example 1 was repeated by introducing 1,456 SCFH of the main protective atmosphere containing nitrogen, 3% hydrogen and 0.4% natural gas into the furnace through the transition zone 20. A de-lubricating atmosphere containing 80 SCFH of pure nitrogen was introduced into the preheating zone of the furnace through an improperly designed diffuser. The Reynolds number of the de-lubricating atmosphere introduced through the holes in the diffuser was ~490 and the value of momentum ratio was ~5, both of which did not meet the de-lubricating atmosphere flow introduction parameters specified earlier in the main body of the text. The design and location of an improperly designed diffuser were same as described earlier. The furnace was operated using the same operating parameters including operating temperature, belt speed, etc. as described earlier. A number of transverse rupture strength test bars described earlier were processed along with a full load of parts in the furnace.

The test bars sintered in this experiment were heavily covered with undesirable soot and dark residue, indicating improper removal of lubricant from the test bars in the preheating zone of the furnace. The results of this experiment showed that a low flow rate of a de-lubricating atmosphere containing no oxidant and the de-lubricating atmosphere introduced through an improperly designed diffuser are not good enough to remove or sweep lubricant vapors away from the surface of compacts in the preheating zone of the furnace and avoid the formation of soot and residue on the surface of compacts.

EXAMPLE 2B

A de-lubricating followed by sintering experiment described in Example 2A was repeated using similar conditions with the exception of using 200 SCFH de-lubricating atmosphere containing pure nitrogen. The Reynolds number of the de-lubricating atmosphere introduced through the holes in the diffuser was ~1,230 and the value of momentum ratio was ~12, both of which did not meet the de-lubricating atmosphere flow introduction parameters specified earlier in the main body of the text. The furnace was operated using the same operating parameters including operating temperature, belt speed, etc. as described earlier. A number of transverse rupture strength test bars described earlier were processed along with a full load of parts in the furnace.

The test bars sintered in this experiment were heavily covered with undesirable soot and dark residue, indicating improper removal of lubricant from the test bars in the preheating zone of the furnace. The results of this experiment showed that a high flow rate of a de-lubricating atmosphere containing no oxidant and the de-lubricating atmosphere introduced through an improperly designed diffuser are not good enough to remove or sweep lubricant vapors away from the surface of compacts in the preheating zone of the furnace and avoid the formation of soot and residue on the surface of compacts.

EXAMPLE 2C

A de-lubricating followed by sintering experiment described in Example 1 was repeated by introducing 1,256 SCFH of the main protective atmosphere containing nitrogen, 3% hydrogen and 0.4% natural gas into the furnace 10 through the transition zone 20. A de-lubricating atmosphere containing 100 SCFH of pure nitrogen was introduced into the preheating zone 12 of the furnace 10 through a properly designed diffuser. The design and location of a properly designed diffuser were same as described above. The Reynolds number of the de-lubricating atmosphere introduced through the holes in the diffuser was ~1,790 and the value of momentum ratio was ~84. The de-lubricating atmosphere flow introduction parameter Reynolds number did not meet the minimum value specified earlier in the main body of the text. The furnace was operated using the same operating parameters including operating temperature, belt speed, etc. as described earlier. A number of transverse rupture strength test bars described earlier were processed along with a full load of parts in the furnace.

The test bars sintered in this experiment were heavily covered with undesirable soot and dark residue, indicating improper removal of lubricant from the test bars in the preheating zone of the furnace. The results of this experiment showed that a low flow of a de-lubricating atmosphere containing no oxidant is not good enough to remove or sweep lubricant vapors away from the surface of compacts in the preheating zone of the furnace and avoid the formation of soot and residue on the surface of compacts.

EXAMPLE 2D

A de-lubricating followed by sintering experiment such as described in Example 2C was repeated using similar conditions with the exception of using 200 SCFH de-lubricating atmosphere containing pure nitrogen. The Reynolds number of the de-lubricating atmosphere introduced through the holes in the diffuser was ~3,580 and the value of momentum ratio was ~165. The furnace was operated using the same operating parameters including operating temperature, belt speed, etc. as described earlier. A number of transverse rupture strength test bars described earlier were processed along with a full load of parts in the furnace.

The test bars sintered in this experiment were heavily covered with undesirable soot and dark residue, indicating improper removal of lubricant from the test bars in the preheating zone of the furnace. The results of this experiment showed that a high flow rate of a de-lubricating atmosphere containing no oxidant is not good enough to remove or sweep lubricant vapors away from the surface of compacts in the preheating zone of the furnace and avoid the formation of soot and residue on the surface of compacts. The results showed that a de-lubricating atmosphere containing no oxidant is not effective in removing lubricant even if it is introduced through a properly designed diffuser and using the right de-lubricating atmosphere flow introduction parameters.

The experimental data in Examples 2A to 2D clearly showed that the use of an inert gas (or a carrier gas without an oxidant) as a de-lubricating atmosphere is not effective in removing lubricant or sweeping lubricant vapors away from the powder metal compacts in the preheating zone of a sintering furnace. The data also showed that the lubricant removal was not affected by introducing an inert gas (or a carrier gas without an oxidant) into the preheating zone through an improperly designed diffuser or a properly designed diffuser and using the right de-lubricating atmosphere flow introduction parameters. Furthermore, the data suggested that a very high flow rate of an inert gas (or a carrier gas without an oxidant) might be needed to improve removal of lubricant from powder metal compacts in the preheating zone of a sintering furnace.

EXAMPLE 3A

A de-lubricating followed by a sintering experiment such as described in Example 2A was repeated by introducing 1,456 SCFH of the main protective atmosphere containing nitrogen, 3% hydrogen and 0.4% natural gas into the furnace through the transition zone. A de-lubricating atmosphere containing 80 SCFH of nitrogen mixed with moisture was introduced into the preheating zone of the furnace through an improperly designed diffuser. The concentration of moisture in the de-lubricating gas was very high—it was about 4.5% by volume. The design and location of an improperly designed diffuser were same as described earlier. The Reynolds number of the de-lubricating atmosphere introduced through the holes in the diffuser was ~490 and the value of momentum ratio was ~5, both of which did not meet the de-lubricating atmosphere flow introduction parameters specified above. The furnace was operated using the same operating parameters including operating temperature, belt speed, etc. as described earlier. A number of transverse rupture strength test bars described earlier were processed along with a full load of parts in the furnace.

The test bars sintered in this experiment were covered with undesirable soot and dark residue, indicating incomplete removal of lubricant from the test bars in the preheating zone of the furnace. The results of this experiment showed that a low flow rate of a de-lubricating atmosphere containing high concentration of an oxidant and the de-lubricating atmosphere introduced through an improperly designed diffuser with incorrect de-lubricating atmosphere introduction parameters are not good enough to remove lubricant from the surface of compacts in the preheating zone of the furnace and avoid the formation of soot and residue on the surface of compacts.

EXAMPLE 3B

A de-lubricating followed by a sintering experiment such as described in Example 3A was repeated using similar conditions with the exception of using 200 SCFH de-lubricating atmosphere containing nitrogen and 4.5% moisture. The Reynolds number of the de-lubricating atmosphere introduced through the holes in the diffuser was ~1,230 and the value of momentum ratio was ~12, both of which did not meet the de-lubricating atmosphere flow introduction parameters specified above. The furnace was operated using the same operating parameters including operating temperature, belt speed, etc. as described earlier. A number of transverse rupture strength test bars described earlier were processed along with a full load of parts in the furnace.

The test bars sintered in this experiment were heavily covered with undesirable soot and dark residue, indicating improper removal of lubricant from the test bars in the preheating zone of the furnace. The results of this experiment showed that a high flow rate of a de-lubricating atmosphere containing high concentration of an oxidant and the de-lubricating atmosphere introduced through an improperly designed diffuser with incorrect de-lubricating atmosphere introduction parameters are not good enough to remove lubricant from the surface of compacts in the preheating zone of the furnace and avoid the formation of soot and residue on the surface of compacts.

The experimental data in Examples 3A to 3B clearly showed that the introduction of a de-lubricating atmosphere containing nitrogen and a high concentration of an oxidant into the preheating zone of a sintering furnace through an improperly designed diffuser is not effective in removing lubricant from powder metal compacts. These examples also showed that it is extremely important to satisfy all the design parameters specified for designing a diffuser and selecting the de-lubricating atmosphere flow to effectively remove lubricants from the powder metal compacts. Finally, the data indicated that a very high flow rate of a de-lubricating atmosphere or very high concentration of an oxidant might be needed to improve lubricant removal if the de-lubricating gas is introduced through an improperly designed diffuser.

EXAMPLE 4A

A number of de-lubricating followed by sintering experiments similar to the one described in Example 2A were carried out by introducing 1,256 SCFH of the main protective atmosphere containing nitrogen, 3% hydrogen and 0.4% natural gas into the furnace through the transition zone. A de-lubricating atmosphere containing 75 SCFH of nitrogen mixed with moisture as an oxidant was introduced into the preheating zone of the furnace through a properly designed diffuser. The moisture content in the de-lubricating atmosphere used in these experiment was selected from 0.4, 1.0, 2.0 and 3.0% by volume. The design and location of a properly designed diffuser were same as described earlier. The Reynolds number of the de-lubricating atmosphere introduced through the holes in the diffuser was ~1,345 and the value of momentum ratio was ~63. The de-lubricating atmosphere flow introduction parameter Reynolds number did not meet the minimum value specified above. The furnace was operated using the same operating parameters including operating temperature, belt speed, etc. as described earlier. A number of transverse rupture strength test bars described earlier were processed along with a full load of parts in the furnace.

The test bars sintered with 0.4% moisture in the de-lubricating atmosphere were covered heavily with undesirable soot and dark residue, indicating improper removal of lubricant from the test bars in the preheating zone of the furnace. The presence of soot and dark residue on the surface of sintered test bars decreased somewhat with increasing moisture content in the de-lubricating atmosphere. More importantly, the test bars sintered in the presence of a high moisture content (3% moisture) in the de-lubricating atmosphere were still covered with soot and dark residue. The results of these experiment indicated that a considerably higher than 3% moisture in the de-lubricating atmosphere would be needed to significantly improve removal of lubricant from compacts in the preheating zone of a sintering furnace. However, it is not practical to use more than 3% moisture in the de-lubricating atmosphere because moisture would start condensing in the transfer line.

EXAMPLE 4B

A number of de-lubricating followed by sintering experiments similar to the one described in Example 4A were carried out by introducing 1,256 SCFH of the main protective atmosphere containing nitrogen, 3% hydrogen and 0.4% natural gas into the furnace through the transition zone. A de-lubricating atmosphere containing 75 SCFH of nitrogen mixed with carbon dioxide as an oxidant was introduced into the preheating zone of the furnace through a properly designed diffuser. The amount of carbon dioxide in the de-lubricating atmosphere used in these experiments was selected from 13.33, 33.33, 53.33, 66.67, and 80% by volume. The design and location of a properly designed diffuser were same as described earlier. The Reynolds number of the de-lubricating atmosphere introduced through the holes in the diffuser was ~1,345 and the value of momentum ratio was ~63. The de-lubricating atmosphere flow introduction parameter Reynolds number did not meet the minimum value specified above. The furnace was operated using the same operating parameters including operating temperature, belt speed, etc. as described earlier. A number of transverse rupture strength test bars described earlier were processed along with a full load of parts in the furnace.

The test bars sintered with 13.33% carbon dioxide in the de-lubricating atmosphere were covered heavily with undesirable soot and dark residue, indicating improper removal of lubricant from the test bars in the preheating zone of the furnace. The presence of soot and dark residue on the surface of sintered test bars decreased somewhat with increasing the amount of carbon dioxide in the de-lubricating atmosphere. More importantly, the test bars sintered in the presence of very high amount of carbon dioxide (80% carbon dioxide) in the de-lubricating atmosphere were still covered with soot and dark residue. The results of these experiment indicated that a considerably higher amount of carbon dioxide than 80% in the de-lubricating atmosphere would be needed to significantly improve removal of lubricant from compacts in the preheating zone of a sintering furnace.

EXAMPLE 4C

A number of de-lubricating followed by sintering experiments similar to the one described in Example 4A were carried out by introducing 1,256 SCFH of the main protective atmosphere containing nitrogen, 3% hydrogen and 0.4% natural gas into the furnace through the transition zone. A de-lubricating atmosphere containing 75 SCFH of nitrogen mixed with air as an oxidant was introduced into the preheating zone of the furnace through a properly designed diffuser. The concentration of air in the de-lubricating atmosphere used in these experiment was selected from 3.33, 6.66, 10.0, and 26.64% by volume. The design and location of a properly designed diffuser were same as described earlier. The Reynolds number of the de-lubricating atmosphere introduced through the holes in the diffuser was ~1345 and the value of momentum ratio was ~63. The de-lubricating atmosphere flow introduction parameter Reynolds number did not meet the minimum value specified above. The furnace was operated using the same operating parameters including operating temperature, belt speed, etc. as described earlier. A number of transverse rupture strength test bars described earlier were processed along with a full load of parts in the furnace.

The test bars sintered with 3.33% air in the de-lubricating atmosphere were covered heavily with undesirable soot and dark residue, indicating improper removal of lubricant from the test bars in the preheating zone of the furnace. The presence of soot and dark residue on the surface of sintered test bars decreased somewhat with increasing the amount of air in the de-lubricating atmosphere. The test bars sintered in the presence of de-lubricating atmosphere containing 10% air were still covered with soot and dark residue. More importantly, there was no soot or dark residue present on the surface of bars sintered in the presence of a de-lubricating atmosphere containing 26.64% air. However, the use of 26.64% air in the de-lubricating gas oxidized the surface of sintered bars. The results of these experiment indicated that extreme care would need to be taken to use air as an oxidant in the de-lubricating atmosphere to remove lubricant in the preheating zone of a sintering furnace.

The results in Examples 4A to 4C showed that the use of low flow rate of de-lubricating atmosphere containing high concentrations of an oxidant is not effective in removing lubricant from powder metal compacts in the preheating zone of a sintering furnace. This is true even if a properly designed diffuser with incorrect de-lubricating atmosphere introduction parameters is used to introduce de-lubricating atmosphere in the preheating zone of the furnace. The data also showed that a high concentration of air in the de-lubricating atmosphere can be used to effectively remove lubricant from powder metal compacts, but at the expense of oxidizing surface of sintered components.

Figure 4:
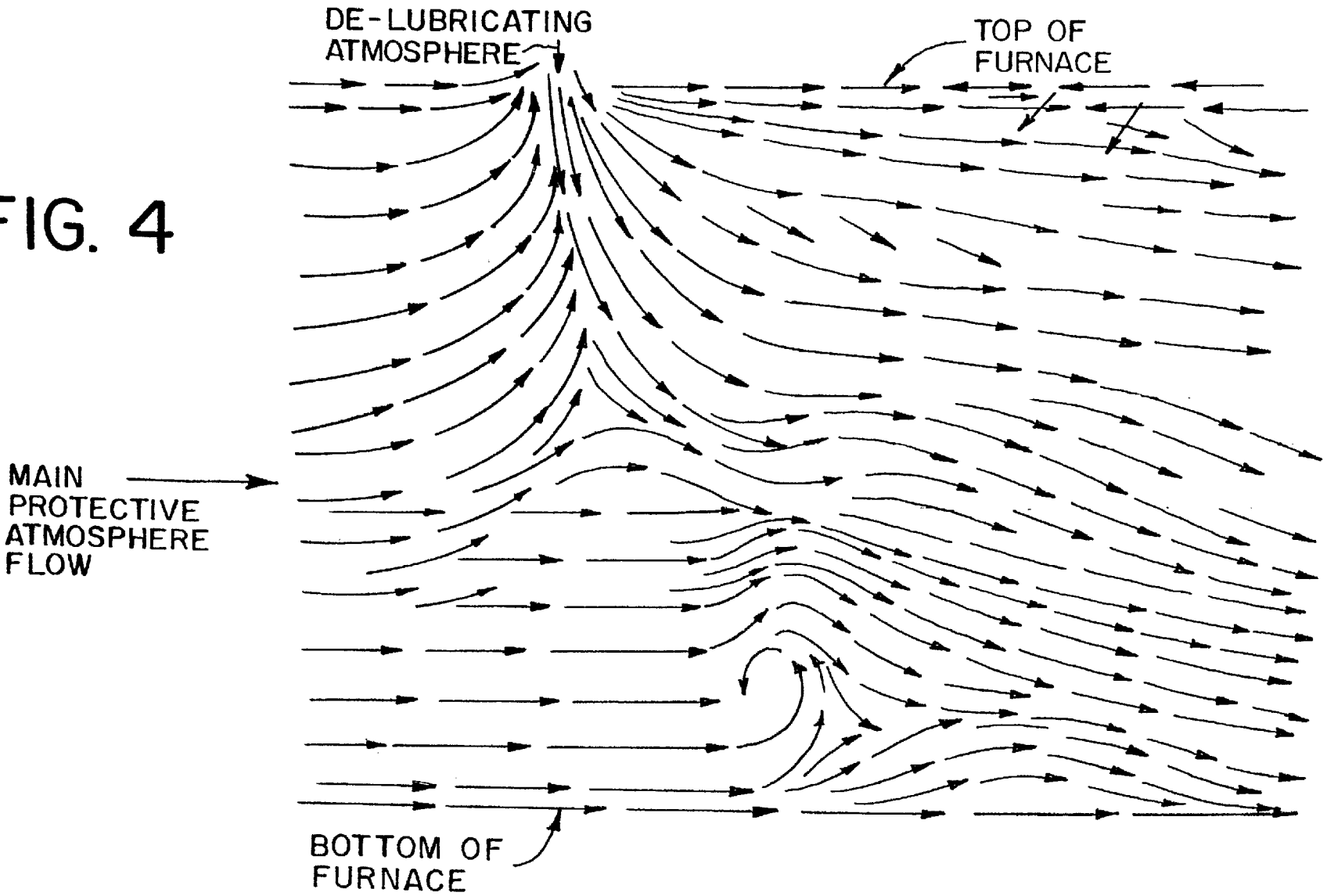
FIG. 4 is flow distribution diagram inside the furnace in the vacinity of the device of FIG. 2 illustrating a low flow rate condition.

The distribution of fluid flow in the preheating zone of the sintering furnace was simulated using a well known computational fluid dynamics software package to explain the reasons of improper lubricant removal even with the use of a high concentration of an oxidant in the de-lubricating atmosphere. The computer simulation showed that the main flow of the atmosphere in the preheating zone of the furnace follows a streamline pattern. It also showed that when a low flow rate of a de-lubricating atmosphere is introduced as a series of jets through a properly designed diffuser, the jets do not have enough momentum to penetrate the streamline flow pattern of the main atmosphere flow as shown in the flow distibution diagram of FIG. 4. Consequently, the de-lubricating atmosphere containing an oxidant does not get a chance to interact with lubricant vapors diffusing out of the surface of powder metal compacts and effectively remove lubricant vapors by decomposing them to smaller and more volatile components. The de-lubricating atmosphere eventually mixes with the main atmosphere flow, but by that time the concentration of an oxidant in the total stream has become very small to be effective in removing lubricant from powder metal compacts.

EXAMPLE 5A

A number of de-lubricating followed by sintering, experiments similar to the one described in Example 2A were carried out by introducing 1,256 SCFH of the main protective atmosphere containing nitrogen, 3% hydrogen and 0.4% natural gas into the furnace through the transition zone. A de-lubricating atmosphere containing 200 SCFH of nitrogen mixed with moisture as an oxidant was introduced into the preheating zone of the furnace through a properly designed diffuser. The moisture content in the de-lubricating atmosphere used in these experiment was selected from 0.4, 1.0, 1.5, 2.0 and 3.0% by volume. The design and location of a properly designed diffuser were same as described earlier. The Reynolds number of the de-lubricating atmosphere introduced through the holes in the diffuser was ~3,585 and the value of momentum ratio was ~167, both of which met the minimum de-lubricating atmosphere flow introduction parameters specified earlier in the main body of the text. The furnace was operated using the same operating parameters including operating temperature, belt speed, etc. as described earlier. A number of transverse rupture strength test bars described earlier were processed along with a full load of parts in the furnace.

The test bars sintered with 0.4% moisture in the de-lubricating atmosphere were covered slightly with undesirable soot and dark residue, indicating improper removal of lubricant from the test bars in the preheating zone of the furnace. However, there was no soot and dark residue present on the surface of sintered test bars with the use of 1% or more moisture in the de-lubricating atmosphere. The test bars on the average showed close to 0.25% growth in linear dimensions that was well within the limits specified by the powder supplier. The apparent surface hardness of sintered bars varied between 61 to 66 HRB that was also well within the range specified by the powder supplier. The transverse rupture strength of sintered bars was close to 90,000 psi which was also within the range specified by the powder supplier. The bulk carbon content in the sintered bars was between 0.7 to 0.8% by weight. Cross-sectional analysis of the bars revealed no surface decarburization. The results of these experiment clearly showed that a de-lubricating atmosphere containing more than 0.4% moisture can be effectively used to de-lubricate powder metal compacts in the preheating zone of a sintering furnace if introduced through a properly designed diffuser using the proper de-lubricating atmosphere introduction parameters.

EXAMPLE 5B

A number of de-lubricating followed by sintering experiments similar to the one described in Example 5A were carried out by introducing 1,256 SCFH of the main protective atmosphere containing nitrogen, 3% hydrogen and 0.4% natural gas into the furnace through the transition zone. A de-lubricating atmosphere containing 200 SCFH of nitrogen mixed with carbon dioxide as an oxidant was introduced into the preheating zone of the furnace through a properly designed diffuser. The concentration of carbon dioxide in the de-lubricating atmosphere used in these experiment was selected from 5, 10, 15, 20, 25 and 30% by volume. The design and location of a properly designed diffuser were same as described earlier. The Reynolds number of the de-lubricating atmosphere introduced through the holes in the diffuser was ~3,585 and the value of momentum ratio was ~167, both of which met the minimum de-lubricating atmosphere flow introduction parameters specified earlier in the main body of the text. The furnace was operated using the same operating parameters including operating temperature, belt speed, etc. as described earlier. A number of transverse rupture strength test bars described earlier were processed along with a full load of parts in the furnace.

The test bars sintered with 10% carbon dioxide or less in the de-lubricating atmosphere were covered lightly with undesirable soot and dark residue, indicating improper removal of lubricant from the test bars in the preheating zone of the furnace. However, there was no soot and dark residue present on the surface of sintered test bars with the use of 15% or more carbon dioxide in the de-lubricating atmosphere. The test bars on the average showed close to 0.24% growth in linear dimensions that was well within the limits specified by the powder supplier. The apparent surface hardness of sintered bars varied between 62 to 67 HRB that was also well within the range specified by the powder supplier. The transverse rupture strength of sintered bars was close to is 95,000 psi which was also within the range specified by the powder supplier. The bulk carbon content in the sintered bars was between 0.7 to 0.8% by weight. Cross-sectional analysis of the bars revealed no surface decarburization. The results of these experiment clearly showed that a de-lubricating atmosphere containing more than 10% carbon dioxide can be effectively used to de-lubricate powder metal compacts in the preheating zone of a sintering furnace if introduced through a properly designed diffuser using the proper de-lubricating atmosphere introduction parameters.

EXAMPLE 5C

A number of de-lubricating followed by sintering experiments similar to the one described in Example 5A were carried out by introducing 1,256 SCFH of the main protective atmosphere containing nitrogen, 3% hydrogen and 0.4% natural gas into the furnace through the transition zone. A de-lubricating atmosphere containing 200 SCFH of nitrogen mixed with air as an oxidant was introduced into the preheating zone of the furnace through a properly designed diffuser. The concentration of air in the de-lubricating atmosphere used in these experiment was 1.25, 2.50, 3.33, 3.75, and 5.0% by volume. The design and location of a properly designed diffuser were same as described earlier. The Reynolds number of the de-lubricating atmosphere introduced through the holes in the diffuser was ~3,585 and the value of momentum ratio was ~1 67, both of which met the minimum de-lubricating atmosphere flow introduction parameters specified earlier in the main body of the text. The furnace was operated using the same operating parameters including operating temperature, belt speed, etc. as described earlier. A number of transverse rupture strength test bars described earlier were processed along with a full load of parts in the furnace.

The test bars sintered with 2.5% air or less in the de-lubricating atmosphere were covered heavily with undesirable soot and dark residue, indicating improper removal of lubricant from the test bars in the preheating zone of the furnace. There was no soot and dark residue present on the surface of bars processed in the presence of a de-lubricating atmosphere containing 3.33, 3.75 and 5% air. However, the surface of bars processed in the presence of a de-lubricating atmosphere containing 5% air were oxidized in the preheating zone and produced an unacceptable frosted surface finish after sintering in the high heating zone of the furnace. The results of these experiment indicated that air can be effectively used to remove lubricant in the preheating zone of the furnace, but one has to be extremely careful in selecting the right concentration of air in the de-lubricating atmosphere.

The results in Examples 5A to 5C showed that the use of a high flow rate of de-lubricating atmosphere containing an oxidant above certain specified concentration is very effective in removing lubricant from powder metal compacts in the preheating zone of a sintering furnace. These examples also showed that it is extremely important to satisfy all the design parameters specified earlier for designing a diffuser and selecting the de-lubricating atmosphere flow to effectively remove lubricants from the powder metal compacts. The data also showed that air can be used as an oxidant in the de-lubricating atmosphere for effectively removing lubricant from powder metal compacts, but one has to be extremely careful in selecting the right concentration of air in the de-lubricating atmosphere.

Figure 5:
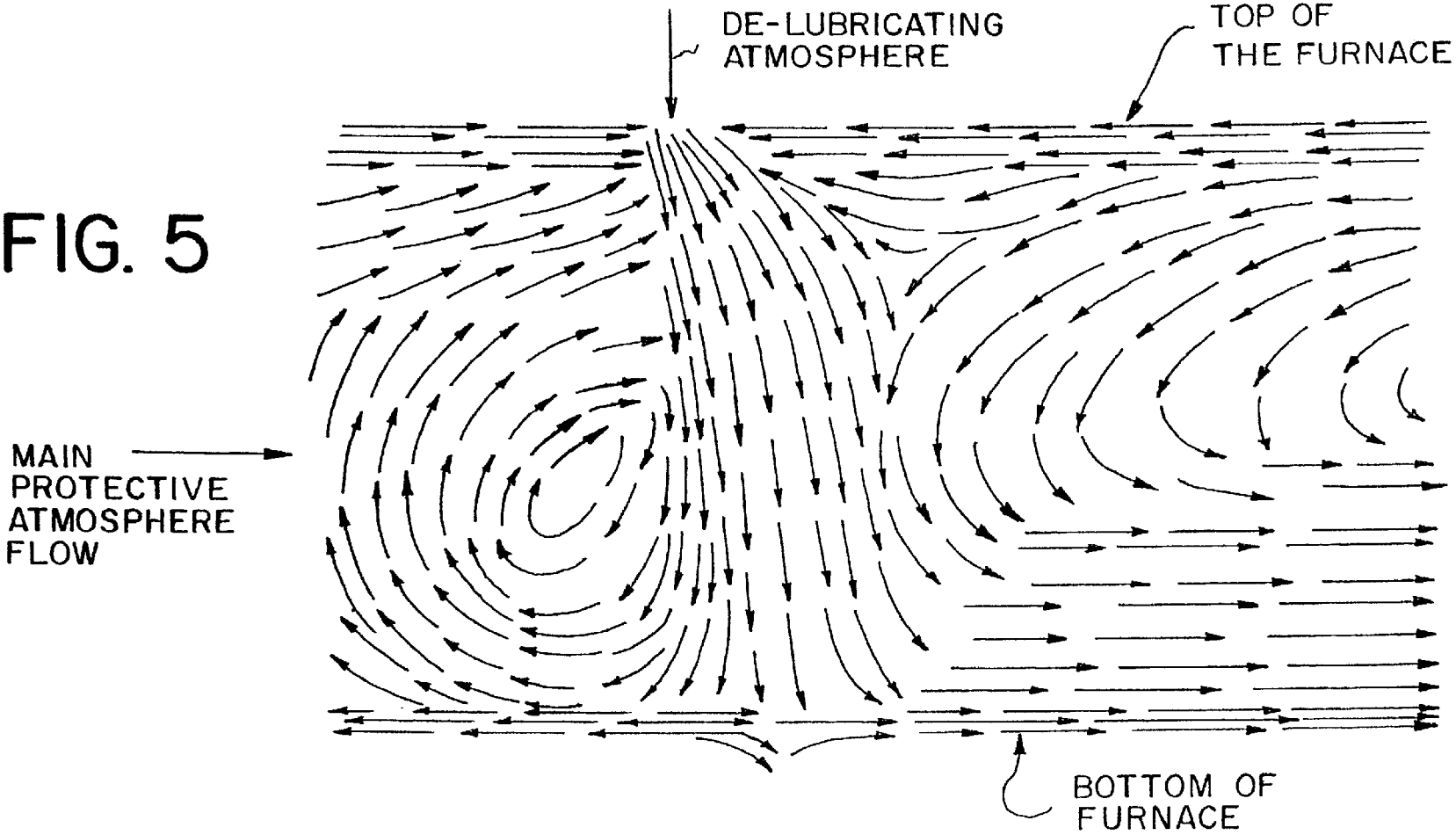
FIG. 5 is a flow distribution diagram inside the furnace in the vacinity of the device of FIG. 2 illustrating a high flow rate condition.

The distribution of fluid flow in the preheating zone of the sintering furnace was simulated with a computer using a well known computational fluid dynamics software package to explain the reasons of proper lubricant removal. The computer simulation showed that when a high flow rate of a de-lubricating atmosphere is introduced as a series of jets through a properly designed diffuser-user, the jets have enough momentum to penetrate the streamline flow pattern of the main atmosphere flow, as shown in the flow distribution diagram of FIG. 5. Consequently, the de-lubricating atmosphere containing an oxidant has ample opportunity to interact with the surface of powder metal compacts and effectively remove lubricant vapors by decomposing them to smaller and more volatile components.

EXAMPLE 6A

A number of de-lubricating followed by sintering experiments similar to the one described in Example SB were carried out by introducing 1,256 SCFH of the main protective atmosphere containing nitrogen, 3% hydrogen and 0.4% natural gas into the furnace through the transition zone. A de-lubricating atmosphere containing 350 SCFH of nitrogen mixed with carbon dioxide as an oxidant was introduced into the preheating zone of the furnace through a properly designed diffuser. The concentration of carbon dioxide in the de-lubricating gas used in these experiment was selected from 2.85, 7.14, and 11.43% by volume. The design and location of a properly designed diffuser were same as descried earlier. The Reynolds number of the de-lubricating atmosphere introduced through the holes in the diffuser was ~6,275 and the value of momentum ratio was ~295, both of which met the minimum de-lubricating atmosphere flow introduction parameters specified earlier in the main body of the text. The furnace was operated using the same operating parameters including operating temperature, belt speed, etc. as described earlier. A number of transverse rupture strength test bars described earlier were processed along with a full load of parts in the furnace.

The test bars sintered in these experiments were free from undesirable soot and dark residue, indicating proper removal of lubricant from the test bars in the preheating zone of the furnace. The results of these experiment clearly showed that the concentration of an oxidant needed for effectively removing lubricant from powder metal compacts can be reduced by using a high flow rate of de-lubricating atmosphere.

EXAMPLE 6B

A number of de-lubricating followed by sintering experiments similar to the one described in Example 5C were carried out by introducing 1,256 SCFH of the main protective atmosphere containing nitrogen, 3% hydrogen and 0.4% natural gas into the furnace through the transition zone. A de-lubricating atmosphere containing 350 SCFH of nitrogen mixed with air as an oxidant was introduced into the preheating zone of the furnace through a properly designed diffuser. The concentration of air in the de-lubricating gas used in these experiments was selected from 0.7 and 1.4% by volume. The design and location of a properly designed diffuser were same as described earlier. The Reynolds number of the de-lubricating atmosphere introduced through the holes in the diffuser was ~6,275 and the value of momentum ratio was ~295, both of which met the minimum de-lubricating atmosphere flow introduction parameters specified earlier in the main body of the text. The furnace was operated using the same operating parameters including operating temperature, belt speed, etc. as described earlier. A number of transverse rupture strength test bars described earlier were processed along with a full load of parts in the furnace.

The test bars sintered in these experiments were free from undesirable soot and dark residue, indicating proper removal of lubricant from the test bars in the preheating zone of the furnace. The results of these experiments clearly showed that the concentration of an oxidant needed for effectively removing lubricant from powder metal compacts could be reduced by using a high flow rate of de-lubricating atmosphere.

EXAMPLE 7

A number of de-lubricating followed by sintering experiments similar to the one described in Example 5A are carried out by introducing 1,256 SCFH of the main protective atmosphere containing nitrogen, 3% hydrogen and 0.4% natural gas into the furnace through the transition zone. A de-lubricating atmosphere containing 350 SCFH of nitrogen mixed with moisture as an oxidant is introduced into the preheating zone of the furnace through a properly designed diffuser. The concentration of moisture in the de-lubricating gas used in these experiments is selected from 0.25, 0.5, and 1.0% by volume. The design and location of a properly designed diffuser are same as described earlier. The Reynolds number of the de-lubricating atmosphere introduced through the holes in the diffuser is ~6.275 and the value of momentum ratio is ~295, both of which meet the minimum de-lubricating atmosphere flow introduction parameters specified earlier in the main body of the text. The furnace is operated using the same operating parameters including operating temperature, belt speed, etc. as described earlier. A number of transverse rupture strength test bars described earlier are processed along with a full load of parts in the furnace.

The test bars sintered in these experiments are free from undesirable soot and dark residue, indicating proper removal of lubricant from the test bars in the preheating zone of the furnace. The results of these experiments clearly show that the concentration of an oxidant needed for effectively removing lubricant from powder metal compacts can be reduced by using a high flow rate of de-lubricating atmosphere.

EXAMPLE 8A

A number of de-lubricating followed by sintering experiments similar to the one described in Example SA are carried out by introducing 1,256 SCFH of the main protective atmosphere containing nitrogen, 3% hydrogen and 0.4% natural gas into the furnace through the transition zone. A de-lubricating atmosphere containing 150 SCFH of nitrogen mixed with moisture as an oxidant is introduced into the preheating zone of the furnace through a properly designed diffuser. The concentration of moisture in the de-lubricating gas used in these experiments is selected from 1.0, 1.5. and 2.0% by volume. The design and location of a properly designed diffuser are same as described earlier. The Reynolds number of the de-lubricating atmosphere introduced through the holes in the diffuser is ~2,690 and the value of momentum ratio is ~125, both of which meet the minimum de-lubricating atmosphere flow introduction parameters specified earlier in the main body of the text. The furnace is operated using, the same operating parameters including operating temperature, belt speed, etc. as described earlier. A number of transverse rupture strength test bars described earlier are processed along with a full load of parts in the furnace.

The test bars sintered in these experiments are free from undesirable soot and dark residue, indicating proper removal of lubricant from the test bars in the preheating zone of the furnace. The results of these experiments clearly show that the concentration of an oxidant required for effectively removing lubricant from powder metal compacts needs to be increased by using a medium flow rate of de-lubricating atmosphere.

EXAMPLE 8B

A number of de-lubricating followed by sintering experiments similar to the one described in Example 5B are carried out by introducing 1,256 SCFH of the main protective atmosphere containing nitrogen, 3% hydrogen and 0.4% natural gas into the furnace through the transition zone. A de-lubricating atmosphere containing 150 SCFH of nitrogen mixed with carbon dioxide as an oxidant is introduced into the preheating zone of the furnace through a properly designed diffuser. The concentration of carbon dioxide in the de-lubricating gas used in these experiments is selected from 15, 20, and 25% by volume. The design and location of a properly designed diffuser are same as described earlier. The Reynolds number of the de-lubricating atmosphere introduced through the holes in the diffuser is ~2,690 and the value of momentum ratio is ~125, both of which meet the minimum de-lubricating atmosphere flow introduction parameters specified earlier in the main body of the text. The furnace is operated using the same operating parameters including operating temperature, belt speed, etc. as described earlier. A number of transverse rupture strength test bars described earlier are processed along with a full load of parts in the furnace.

The test bars sintered in these experiments are free from undesirable soot and dark residue, indicating proper removal of lubricant from the test bars in the preheating zone of the furnace. The results of these experiments clearly show that the concentration of an oxidant required for effectively removing lubricant from powder metal compacts needs to be increased by using a medium flow rate of de-lubricating atmosphere.

EXAMPLE 8C

A number of de-lubricating followed by sintering experiment similar to the one described in Example 5A are carried out by introducing 1,256 SCFH of the main protective atmosphere containing nitrogen, 3% hydrogen and 0.4% natural gas into the furnace through the transition zone. A de-lubricating atmosphere containing 150 SCFH of nitrogen mixed with air as an oxidant is introduced into the preheating zone of the furnace through a properly designed diffuser. The concentration of air in the de-lubricating gas used in these experiments is selected from 2.0, 3.0, and 4.0% by volume. The design and location of a properly designed diffuser are same as described earlier. The Reynolds number of the de-lubricating atmosphere introduced through the holes in the diffuser is ~2,690 and the value of momentum ratio is ~125, both of which meet the minimum de-lubricating atmosphere flow introduction parameters specified earlier in the main body of the text. The furnace is operated using the same operating parameters including operating temperature, belt speed, etc. as described earlier. A number of transverse rupture strength test bars described earlier are processed along with a full load of parts in the furnace.

The test bars sintered in these experiments are free from undesirable soot and dark residue, indicating proper removal of lubricant from the test bars in the preheat zone of the furnace. The results of these experiments clearly show that the concentration of an oxidant required for effectively removing lubricant from powder metal compacts needs to be increased by using a medium flow rate of de-lubricating atmosphere.

The above Examples show that the concentration of an oxidant needed for effectively removing lubricant from powder metal compacts depends upon the flow rate of the de-lubricating atmosphere. The results also show that one can use a low concentration of an oxidant with a high flow rate of de-lubricating atmosphere or a high concentration of an oxidant with a low flow rate of de-lubricating atmosphere to effectively remove lubricant from the powder metal compacts in the preheating zone of a continuous sintering furnace provided a properly designed diffuser is used to introduce de-lubricating atmosphere and the de-lubricating atmosphere introduction parameters are satisfied. However, the concentration of an oxidant in the de-lubricating atmosphere and the total flow rate of a de-lubricating atmosphere must be above certain minimum value to be effective in (1) penetrating streamlines of main atmosphere flow, (2) interacting with the surface of powder metal compacts, and (3) removing lubricant from powder metal compacts in the preheating zone of a sintering furnace. This right combination of the de-lubricating atmosphere flow rate and the concentration of an oxidant depends on the furnace geometry such as width and height, and can be determined by conducting a few trials.

While a single diffuser has been shown to be effective, it is within the scope of the present invention to use more than one and possibly multiple diffusers placed between the entry end of the pre-heat zone of the furnace and a location in the pre-heat zone or section of the furnace where the parts to be treated have reached a temperature of about 1450° F. It is also within the scope of the present invention to have more than one row of holes or apertures in a single diffuser.

Having thus described our invention what is desired to be secured by letters patent of the United States, without limitations, is set forth in the appended

What is claimed:

1. A device for introducing a de-lubricating atmosphere into a furnace comprising in combination;

a conduit having a first end and a second end, said conduit adapted to extend across the width of said furnace in one of said furnace or a portion of said furnace where articles to be de-lubricated are heated to a temperature between about 400° F. and about 1500° F.;

said conduit containing a plurality of apertures to direct said atmosphere introduced into a first end of said conduit at said articles said apertures adapted to introduce said atmosphere in a turbulent flow regime said conduit constructed to have a diffuser design criteria of about 1.5, said diffuser design criteria (DDC) determined according to the equation:

$$DDC = \frac{D}{d\sqrt{N}} \text{ wherein:}$$

D is the diameter of, or equivalent diameter if it is not circular in cross-section, of said conduit, d is the diameter of the apertures and N is the total number of apertures.

2. A device according to claim 1 wherein said de-lubricating atmosphere flow is slected so that the Reynolds Number of the de-lubricating atmosphere introduced in said furnace is above about 2,000; said Reynolds Number calculated according to the formula:

$$\frac{dU\rho}{\mu} \text{ where:}$$

d is the diameter of a hole, U is the linear velocity of the de-lubricating gas flow through a hole, ρ is the density of the de-lubricating gas, and $\mu$ is the viscosity of the de-lubricating atmosphere.

3. A device according to claim 1 wherein said de-lubricating atmosphere flow is selected so that said Reynolds Number is above about 3,000.

4. A device according to claim 1 wherein said de-lubricating atmosphere flow is selected so that said Reynolds Number is above about 3,500.

5. A device according to claim 1 wherein said de-lubricating atmosphere flow is selected so that said flow of de-lubricating atmosphere will penetrate streamlines in an atmosphere in said furnace said flow rate calculated according to determining total momentum Ratio R calculated using the formula $$R = \frac{U}{V}\sqrt{\frac{\rho}{\rho a}} \quad \text{wherein}$$

ρ is the density of the de-lubricating atmosphere, pa is the density of the main protection atmosphere, U is the linear velocity of the de-lubricating gas through a hole, and V is the linear velocity of the main protective atmosphere flow.

* * * * *